US005259609A

United States Patent [19]

Brame et al.

[11] Patent Number: 5,259,609

[45] Date of Patent: Nov. 9, 1993

[54] BLANK STACKING APPARATUS

[75] Inventors: Thierry Brame, La Ferte-Saint-Aubin; Christian Galateau, Jouy-le-Potier, both of France

[73] Assignee: Komori-Chambon, Orleans-La-Source, France

[21] Appl. No.: 868,453

[22] Filed: Apr. 14, 1992

[30] Foreign Application Priority Data

Apr. 18, 1991 [FR] France ..... 91 04805

[51] Int. Cl.[5] ..... B65H 31/04; B65H 31/10; B65H 31/36

[52] U.S. Cl. ..... 271/213; 271/217; 271/221

[58] Field of Search ..... 271/207, 210, 213-215, 271/217, 221, 224

[56] References Cited

U.S. PATENT DOCUMENTS

| | | | |
|---|---|---|---|
| 1,144,269 | 6/1915 | Vickery | 271/215 |
| 1,387,602 | 8/1921 | Veck . | |
| 2,957,691 | 10/1960 | Williams | 271/215 |
| 3,239,944 | 3/1966 | Gebert | 271/210 |
| 3,418,725 | 12/1968 | Ruud | 271/210 |
| 4,133,523 | 1/1979 | Berthelot | 271/215 |
| 4,296,684 | 10/1981 | Wangermann | 271/177 |
| 4,585,225 | 4/1986 | Miura | 271/221 |
| 4,784,289 | 11/1988 | Ogawa et al. | 271/213 |

FOREIGN PATENT DOCUMENTS

| | | | |
|---|---|---|---|
| 2807295 | 8/1978 | Fed. Rep. of Germany . | |
| 185674 | 8/1987 | Japan | 271/221 |
| 605714 | 5/1978 | U.S.S.R. | 271/221 |

OTHER PUBLICATIONS

Patent Abstracts of Japan-vol. 8, No. 69 (M-286)(1506), Mar. 31, 1984; and JP-A-58216858 (Fuji Shashin Film), Dec. 16, 1983.

*Primary Examiner*—Robert P. Olszewski
*Assistant Examiner*—Steven M. Reiss
*Attorney, Agent, or Firm*—McAulay Fisher Nissen Goldberg & Kiel

[57] ABSTRACT

An apparatus is disclosed for stacking, from above, thin, flat articles such as blanks of cardboard or like material, of variable shapes and formats, these blanks being supplied, upstream, on a conveyor and being successively deposited on one another on the upper laying plane of a stacking-jolting table. This apparatus is characterized in that the laying plane of the stacking-jolting table is constituted, on the one hand, by a large continuous principal surface, and, on the other hand, by an auxiliary bearing surface located at the upstream end of the table, and a device is provided for vertically displacing the auxiliary bearing surface with respect to the principal surface.

19 Claims, 4 Drawing Sheets

BLANK STACKING APPARATUS

FIELD OF THE INVENTION

The present invention relates to an apparatus for stacking, from above, thin, flat articles such as blanks of cardboard or like material, of variable shapes and formats.

BACKGROUND OF THE INVENTION

Various apparatus for stacking on a laying plane formed by a table, mobile or not, individual cardboard blanks which are subsequently intended to constitute packings, are known at the present time. Certain of these laying planes are constituted by groups of planar bands, for example by means of parallel bars or with the aid of belts, regularly spaced apart and parallel to the direction of advance of the blanks supplying the stack.

These apparatus thus allow a sufficient imbrication between the spaced apart parallel planar bands constituting the laying plane, of means for frontally stopping the blanks, or stops, on the one hand, and/or of means for laterally jolting these blanks between the planar bands, on the other hand. Such an imbrication ensures, at the beginning of the formation of the stack of blanks, a frontal contact with the lower parts of the stops and/or the lateral jolter elements, i.e. avoids the first blanks being introduced beneath these means for aligning the edges of the stacked blanks, which would decrease the quality of jolting of the stacks constituted in their lower part. This contact is then naturally maintained when the stack increases, as long as its height does not exceed the capacity of the blank edge alignment means.

Whether it be produced by a series of discontinuous supports and/or notches at a predefined pitch in a table adapted to the maximum width occupied by the blanks, this technique of imbrication presents drawbacks of complexity of design and/or of adjustment, being given the multiplicity of the parts necessary for making these discontinuous zones and/or their change of lateral position, with respect to the direction of advance of the blanks, which is caused by a change of format of the blanks.

It is an object of the present invention to provide a blank stacking apparatus comprising a stacking/jolting table assembly of particularly simple design which no longer depends on a predefined pitch for adjustments in the lateral direction.

SUMMARY OF THE INVENTION

To that end, this apparatus for stacking, from above, thin, flat articles such as blanks of cardboard or like material, of variable shapes and formats, these blanks being supplied, upstream, on a conveyor and being successively deposited on one another on the upper laying plane of a stacking-jolting table, this apparatus comprising a frontal stop device with members for stopping the leading edges of the blanks and a lateral jolting device with jolting flaps reciprocatingly mobile in the transverse direction, is characterized in that the laying plane of the stacking-jolting table is constituted, on the one hand, by a large continuous principal surface, of sufficient extent to be able to support all the stackable blanks whatever their dimensions and the number of stacks formed simultaneously in the transverse direction, and, on the other hand, by an auxiliary bearing surface located at the upstream end of the table, where the rear ends of the stacked blanks are located, extending over the whole width of the principal surface and narrow with respect to the minimum length of the blanks, and in that means are provided for vertically displacing the auxiliary bearing surface with respect to the principal surface so as to raise it with respect to this principal surface and to place it at the level of a raising plane at the beginning of the formation of a stack, when the first blanks of the stack fall on the laying plane, being thus maintained inclined with respect to a horizontal plane, and then to lower this auxiliary bearing surface substantially in the plane of the principal surface of the laying plane during the rest of the formation of the stack.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
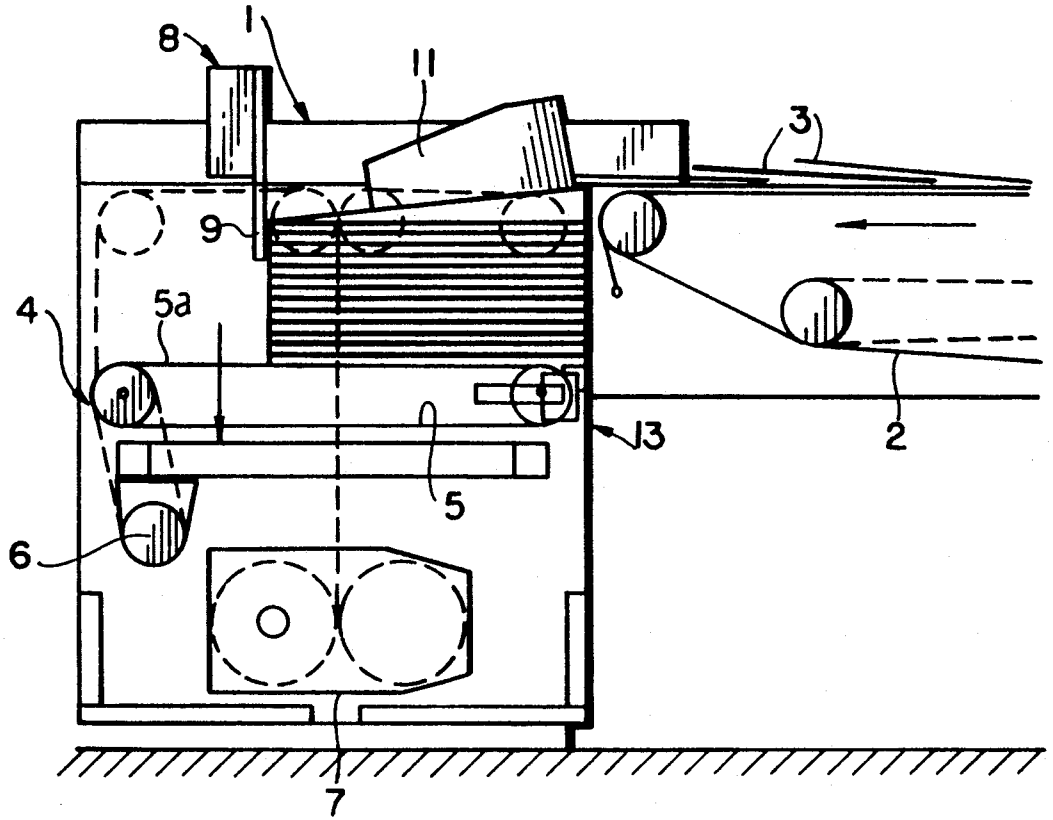
FIG. 1 is a schematic view in elevation of a stacking apparatus according to the invention in the course of receiving a stack of blanks.
Figure 2:
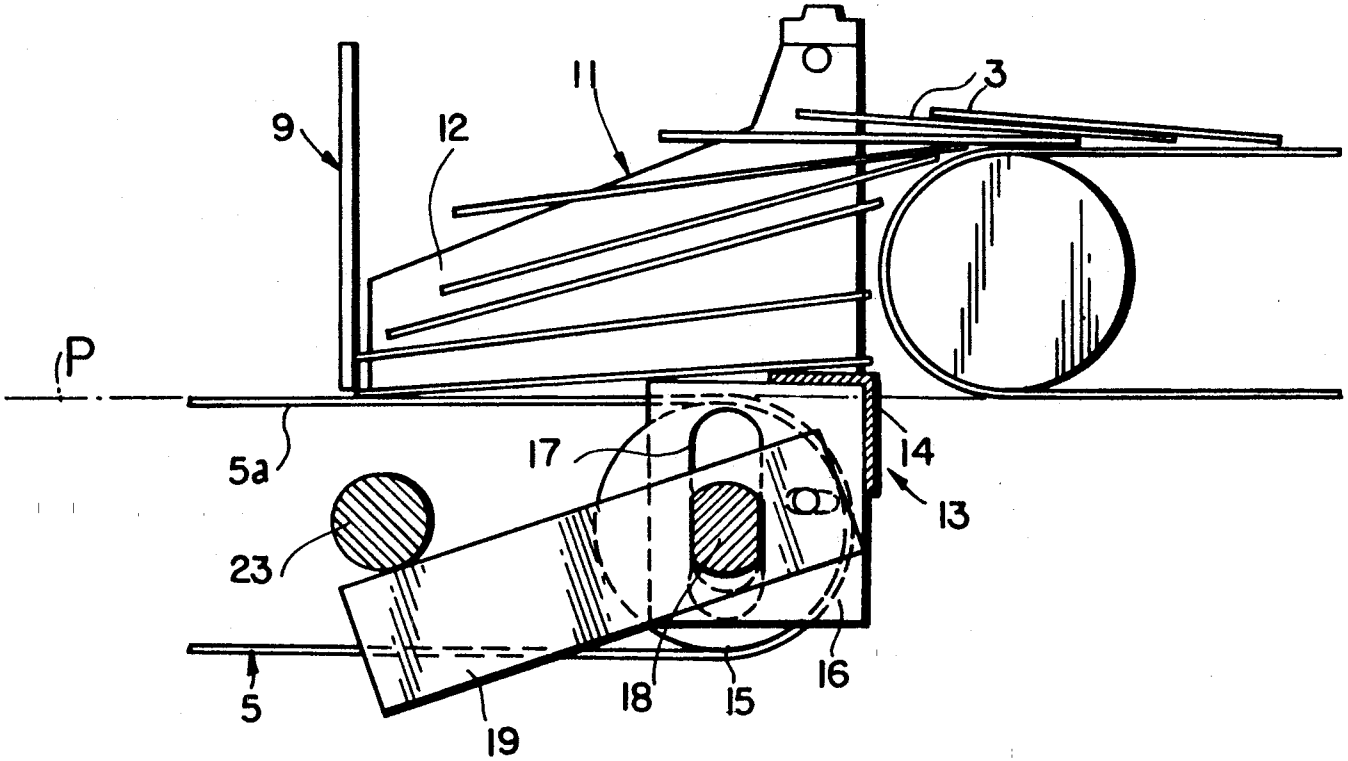
FIG. 2 is a schematic partial view in vertical, longitudinal section, on a larger scale, of the upper part of the stacking apparatus of which the mobile table is in extreme upper position, at the beginning of the formation of a stack of blanks.
Figure 3:
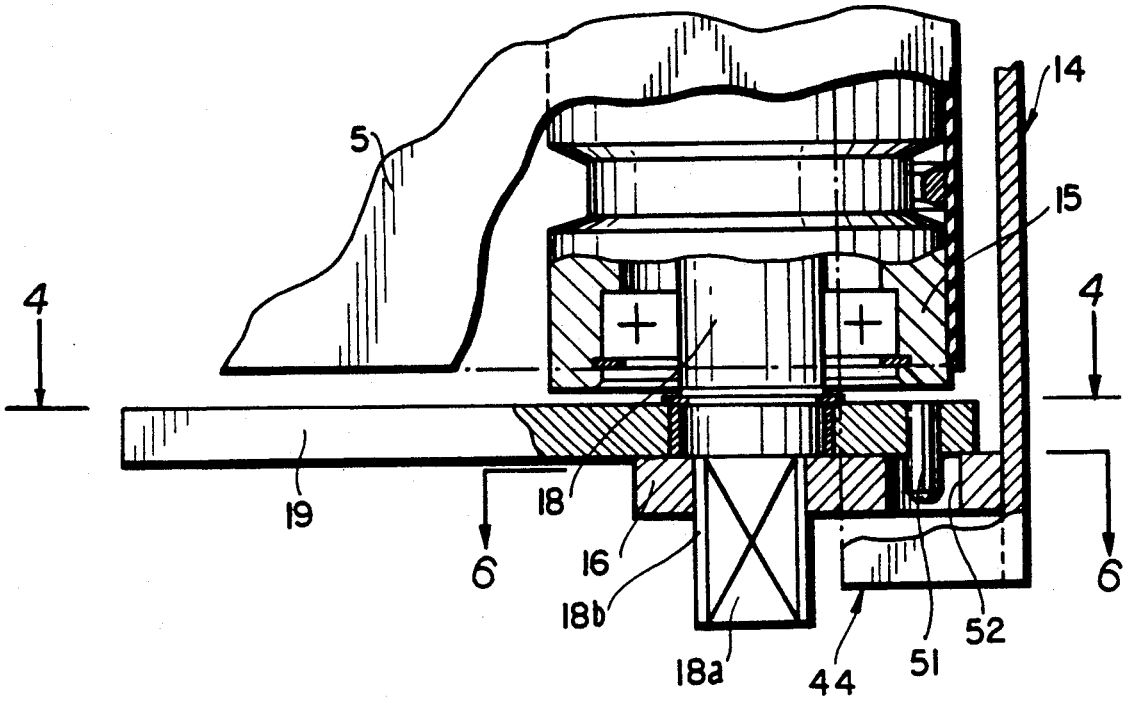
FIG. 3 is a view in horizontal section, on a larger scale, of an upstream lateral part of the stacking-jolting table.
Figure 4:
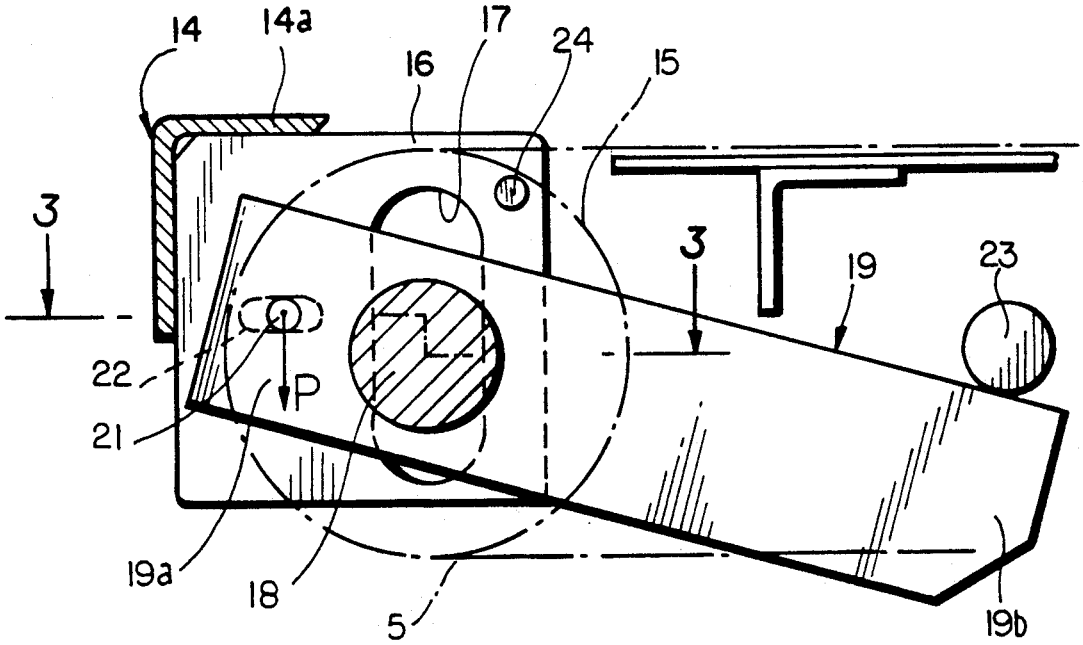
FIG. 4 is a view in vertical, longitudinal section, along line IV—IV of FIG. 3, when the mobile table is in its extreme upper position.
Figure 6:
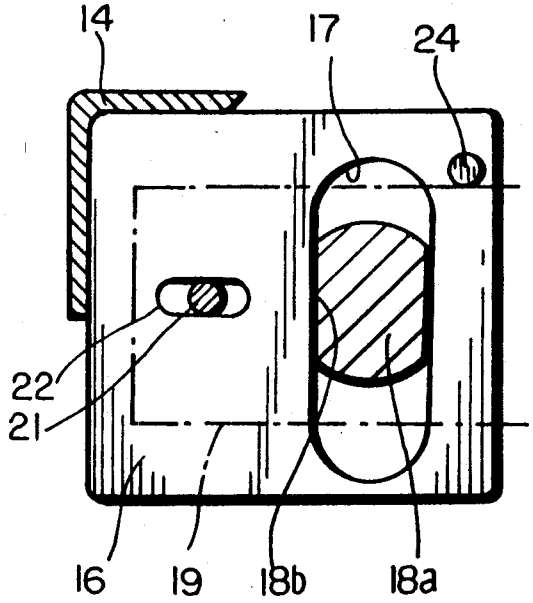
FIG. 6 is a partial view in vertical, longitudinal section along line VI—VI of FIG. 3, the mobile table being assumed to be lowered.

Referring now to the drawings and firstly to FIGS. 1 and 2, the blank stacking apparatus according to the invention, generally designated by reference 1, is disposed downstream of a conveyor 2 by means of which thin, flat articles 3, such as cardboard blanks, are displaced horizontally from right to left in the drawing. These blanks 3 may be spaced apart from one another or may overlap, like "scales", as shown in the drawings.

The stacking apparatus 1 comprises a stacking-jolting table 4 which, in this non-limiting embodiment, is vertically mobile. This table 4 comprises a horizontal chassis on which is mounted a horizontal, longitudinal band 5*a* constituting a principal surface of a plane for laying the blanks 3. This band 5*a* may be independent and fixed on the chassis of the mobile table 4 or, preferably, it may constitute the upper side of an endless conveyor belt 5. The length and width of the conveyor belt 5 are sufficient to enable it to receive, flat, blanks 3 having the maximum format in length and the number of stacks formed simultaneously in the transverse direction. The conveyor belt 5 may be displaced horizontally, over the chassis of the table 4, by a drive device 6 comprising an electric motor and a transmission mechanism. The stacking-jolting table 4 may be displaced vertically, in the two directions, by a motor 7, via an appropriate transmission mechanism comprising, for example, chains passing over toothed guide wheels and connected to the table 4. This table 4 is mobile, following a servo-controlled descent depending on the delivery rate of the blanks 3 then rising rapidly to its upper extreme position, after evacuation of the stack or stacks supplied, in order to be ready to form a new series of stacks of blanks.

The stacking apparatus 1 according to the invention comprises, in its upper part, a frontal stop device which is generally designated by reference 8. This device comprises stop members 9 for the leading edges of the blanks 3, these stop members 9 being able to be constituted by vertical stop rods. These frontal stop rods 9 are placed in a vertical position, above the conveyor belt 5 and they extend to the upper side 5*a* of this conveyor belt 5 with which they are in contact, under a maintained effort, when the table 4 is in its upper extreme position.

The stacking apparatus 1 also comprises a lateral jolting device which is generally indicated by reference 11. This device 11 comprises, for each stack having to be formed, a pair of jolting flaps 12, parallel to each other and which are located in vertical and longitudinal planes. The two flaps 12 of each pair are animated by a reciprocating transverse movement of translation, in opposite directions, under the control of appropriate means well known in the art.

Right at the beginning of the formation of a stack, the vertical frontal stop rods 9 extend up to the upper side 5*a* of the conveyor belt 5, then in upper extreme position, the lower ends of the stop rods 9, in contact with the upper side 5*a*, thus defining a horizontal starting plane P for the formation of the stack of blanks. Furthermore, the lower horizontal edges of the jolting flaps 12 are located at a level slightly higher than that of the starting plane P, thus defining a slight vertical operational clearance. The blanks 3 which are conveyed by conveyor 2, drop on one another on the stacking-jolting table 4, i.e. on the conveyor belt 5, and their leading edges are stopped by the vertical frontal stop rods 9. These rods therefore precisely determine the longitudinal position of the stack of blanks being formed. In the lateral sense, the jolting flaps 12 are animated by a reciprocating beating movement and they ensure a precise superposition, in the lateral sense, of the successive blanks as the stack of blanks increases in height.

As there is a slight operational clearance between the lower horizontal edges of the jolting flaps 12 and the upper side 5*a* of the conveyor belt 5 in upper extreme position, i.e. the starting plane P, there is provided, at the location of the upstream end of the conveyor belt 5, i.e. where the rear ends of the stacked blanks 3 are located, a device 13 for momentarily raising the rear of the first blanks 3 dropping on the conveyor belt 5, this in order to avoid a poor quality of the jolting in this zone. This momentary raising device 13 raises the rear of the first blanks 3 above the starting plane P of laying of the blanks, in order to delay escape thereof under the jolting flaps 12 by reason of the servo-controlled descent of the laying plane constituted by the upper side 5*a* of the conveyor belt 5.

Figure 5:
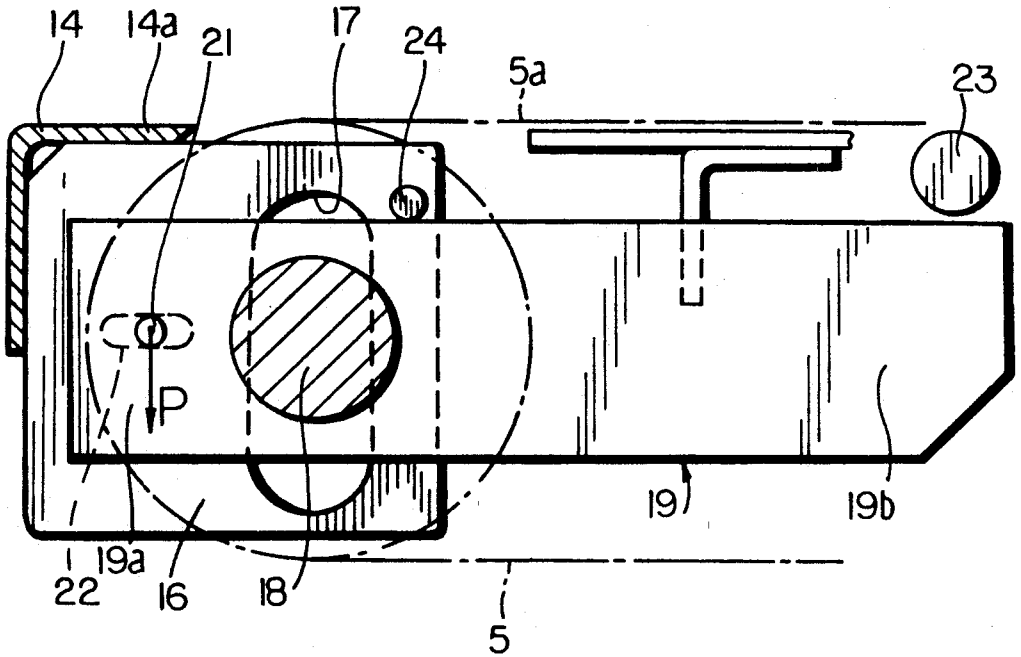
FIG. 5 is a view in vertical, longitudinal section similar to that of FIG. 4, the mobile table being shown in a lowered position.

As may be seen more readily in FIGS. 3 to 6, the raising device 13 comprises a crosspiece 14 which forms an auxiliary bearing surface for the rear of the blanks 3 and which extends transversely and horizontally along and in the proximity of the upstream guide roller 15 of the conveyor belt 5. This raising crosspiece 14 is constituted by an angle which is mounted to move vertically, over a short distance, with respect to the chassis of the conveyor belt 5. The crosspiece 14 comprises a horizontal flange 14*a* which may thus be displaced between a lower position in which it is located substantially in the horizontal plane of the upper side 5*a* of the conveyor belt 5, as shown in FIG. 5, and an upper position in which it is offset slightly above this plane. The crosspiece 14 is fast, at each of its ends, with a vertical longitudinal plate 16 which is pierced right through with a vertical oblong slot 17. This slot is traversed by the end part 18*a* of a shaft 18, on which shaft the upstream guide roller 15 of the conveyor belt 15 rotates via roller bearings.

The end part 18*a* of the shaft 18 presents two diametrically opposite vertical flat parts, which pass through the slot 17, being tightly engaged therein, so as to ensure guiding of the two end plates 16 in the vertical direction and consequently that of the crosspiece 14. The vertical movement of each plate 16 is controlled by a lever 19 which is mounted to rotate on the circular end part of the shaft 18 from which issues the end part 18*a* with flat parts 18*b*. The lever 19 comprises two arms of different lengths, namely an arm of short length 19*a*, directed upstream, and an arm 19*b*, longer than the preceding one, directed downstream. The short arm 19 of the lever 19 is coupled to the plate 16 via a finger 21 of the short arm 19*a* which is engaged in a horizontal oblong slot 22 provided in the associated plate 16. The long arm 19*b* of the lever 19 is the arm manoeuvring the lever and it cooperates with a stop 23 mounted fixed on the upper part of the frame of the stacking apparatus 1. This fixed stop 23 serves as stop for the upper edge of the long arm 19*b* of the lever 19, when the conveyor 5 is displaced in its upper extreme position. On encountering thus the fixed stop 23 by its long arm 19*b*, the lever 19 pivots in clockwise direction about the shaft 18 of the roller 15 and the resulting upward movement of the finger 21 brings about an upward displacement of the plate 16. Consequently, the two plates 16 and the crosspiece 14 are raised slightly above the plane of the upper side 5*a* of the conveyor belt 5. Due to this raising of the crosspiece 14, the first blanks 3 of a new stack are deposited in a slightly inclined position, in abutment, at the front, on the conveyor belt 5 and, at the rear, on the crosspiece 14, as shown in FIG. 2, which makes it possible to place these blanks in correct lateral position by the action of the lateral jolting flaps 12, without risk of these blanks passing under the lower edges of these flaps. When, as the stack of blanks is being formed, the conveyor belt 5 descends, the crosspiece 14 likewise descends progressively with respect to this belt 5, due to the anti-clockwise pivoting of the lever 19 about shaft 18. Such pivoting is essentially due to the weight of the assembly constituted by the two plates 16 and the crosspiece 14, which weight is exerted, via the slot 22 and the finger 21, on the short arm 19*a*, thus creating a torque in anti-clockwise direction.

At a certain moment, the long arm 19*b* moves away from the stop 23, downwardly, and the lever 19 is maintained, from that instant, in horizontal position, as shown in FIG. 5, since the upper edge of the long arm 19*b* of this lever 19 then comes into abutment beneath a lug 24 provided in the upper part of the plate 16. Consequently, it is seen that the raising crosspiece 14 is progressively retracted downwardly, as the table 4 descends and the stack of blanks 3 increases, in order not to mark or deform the stacked blanks, and the stack of blanks 3 rests flat on the table 4 with a view to evacuation thereof.

Although it has been indicated in the foregoing description that the stacking apparatus was more particularly designed for cardboard blanks, it goes without saying that this apparatus may also be used with any type of thin, flat articles, supplied one after the other, overlapping one another (like "scales") or being separate from one another.

Furthermore, the vertical movement of the lifting crosspiece 14, constituting the auxiliary bearing surface, might be controlled by any independent mechanism, for example by means of a jack whose supply would be controlled selectively from the general control of the operational cycle of the apparatus. Such an independent mechanism would necessarily be used if the stacking apparatus according to the invention comprised a fixed stacking-jolting table, i.e. located at a level lower than that of the upstream conveyor serving to supply the successive blanks having to constitute a stack.

What is claimed is:

1. An apparatus for stacking, from above, thin flat articles such as blanks of cardboard or like material, of variable shapes and formats, these blanks being supplied, upstream, on a conveyor and being successively deposited on one another on the upper laying plane of a stacking-jolting table, comprising a frontal stop device with members for stopping the leading edges of the blanks and a lateral jolting device with jolting flaps reciprocatingly mobile in the transverse direction, wherein the laying plane of the stacking-jolting table is constituted, on the one hand, by a large continuous principal surface, of sufficient extent to be able to support all the stackable blanks of variable shapes and formats and the number of stacks formed simultaneously in the transverse direction, and, on the other hand, by an auxiliary bearing surface located at the upstream end of the table, where the rear ends of the stacked blanks are located, extending over the whole width of the principal surface and narrow with respect to the minimum length of the blanks, and means are provided for vertically displacing the auxiliary bearing surface with respect to the principal surface so as to raise it with respect to this principal surface and to place it at the level of a raising plane at the beginning of the formation of a stack, when the first blanks of the stack fall on a laying plane, being thus maintained inclined with respect to a horizontal plane, and then to lower this auxiliary bearing surface substantially in the plane of the principal surface of the laying plane during the rest of the formation of the stack, said principal surface of the laying plane being constituted by a belt and said auxiliary bearing surface being a crosspiece which extends transversely and horizontally along and in the proximity of the upstream transverse edge of the belt.

2. The apparatus of claim 1, wherein it comprises a frontal stop device comprising stop members in contact with the principal surface of the laying plane of the table.

3. The apparatus of claim 1, wherein the belt constituting the principal surface is the upper side of an endless conveyor belt extending longitudinally over the chassis of the table.

4. The apparatus of claim 3, wherein the means controlling the vertical displacement of the lifting crosspiece comprises a vertical, longitudinal plate fixed with the crosspiece at each end thereof and which is guided to slide vertically, and a pivoting lever with two arms controlling the vertical movement of each said plate, namely a first arm directed upstream and a second arm directed downstream, the first arm of the lever being coupled to said vertical, longitudinal plate to control its vertical movement, the second arm, constituting the arm for manoeuvring the lever, cooperating with actuation means.

5. The apparatus of claim 4 in which the stacking-jolting table is mobile vertically, wherein the means for actuating the crosspiece, to raise this crosspiece in its raising plane, are constituted by a stop mounted fixed on the upper part of the frame of the stacking apparatus and serving as stop for the upper edge of the second arm of the lever, when the mobile table is displaced in its upper, when the mobile table is displaced in its upper extreme position, so as to pivot the lever and provoke a rise of its first arm, each plate and the raising crosspiece.

6. The apparatus of claim 4, wherein each lever controlling the vertical movement of the crosspiece constituting the auxiliary bearing surface is mounted to pivot on the end part of the shaft of an upstream guide roller of the conveyor belt.

7. An apparatus for stacking, from above, thin flat articles such as blanks of cardboard or like material, of variable shapes and formats, these blanks being supplied, upstream, on a conveyor and being successively deposited on one another on the upper laying plane of a stacking-jolting table, comprising a frontal stop device with members for stopping the leading edges of the blanks and a lateral jolting device with jolting flaps reciprocatingly mobile in the transverse direction, wherein the laying plane of the stacking-jolting table is constituted, on the one hand, by a large continuous principal surface, of sufficient extent to be able to support all the stackable blanks of variable shapes and formats and the number of stacks formed simultaneously in the transverse direction, and, on the other hand, by an auxiliary bearing surface located at the upstream end of the table, where the rear ends of the stacked blanks are located, extending over the whole width of the principal surface and narrow with respect to the minimum length of the blanks, the principal surface of the laying plane being constituted by a belt and said auxiliary bearing surface is a crosspiece which extends transversely and horizontally along and in the proximity of the upstream transverse edge of the belt, and means for vertically displacing the auxiliary bearing surface with respect to the principal surface so as to raise it with respect to this principal surface and to place it at the level of a raising plane at the beginning of the formation of a stack, when the first blanks of the stack fall on a laying plane, being thus maintained inclined with respect to a horizontal plane, and then to lower this auxiliary bearing surface substantially in the plane of the principal surface of the laying plane during the rest of the formation of the stack.

8. An apparatus for stacking, from above, thin flat articles such as blanks of material, of variable shapes and formats, said blanks being supplied, upstream, on a conveyor and being successively deposited onto one another on the upper laying plane of a stacking-jolting table, comprising a frontal stop device having members for stopping the leading edges of the blanks;

a lateral jolting device with jolting flaps reciprocatingly mobile in the transverse direction;

said stacking-jolting table having a laying plane comprising a large continuous principal surface, of sufficient extent for supporting stackable blanks of variable shapes and formats, the stacks being formed simultaneously in the transverse direction, and an auxiliary bearing surface located at the upstream end of said table, whereat the rear ends of the stacks blanks are located, extending over the whole width of said principal surface and narrow with respect to the minimum length of the blanks; and means for placing said auxiliary bearing surface at the level of a raising plane at the beginning of the formation of the stack and then for lowering said bearing surface during the rest of formation of said stack and for vertically displacing said auxiliary bearing surface with respect to said principal surface for raising said auxiliary surface with respect to said principal surface for placing it at the level of said raising plane at the beginning of the formation of a new stack, when the first blanks of the stack fall onto a laying plane, being thus maintained inclined with respect to a horizontal plane, and then to lower said auxiliary bearing surface substantially in the plane of the principal surface of the laying plane during the rest of the formation of the stack;

said principal surface of said laying plane including a belt, and said auxiliary bearing surface being a crosspiece which extends transversely and horizontally along and in the proximity of the upstream transverse edge of said belt.

9. The apparatus of claim 8, wherein said principal surface of said laying plane is the upper side of an endless conveyor belt extending longitudinally over the chassis of the table.

10. The apparatus of claim 8, wherein said principal surface of said laying plane is the upper side of an endless conveyor belt extending longitudinally over the chassis of the table.

11. The apparatus of claim 8, wherein said placing means controls the vertical displacement of said lifting crosspiece and comprises a vertical, longitudinal plate fast with each end of said crosspiece and which is guided to slide vertically, and a pivoting lever having two arms controlling the vertical movement of each plate, a first arm of said two arms being directed upstream and a second arm of said two arms being directed downstream, said first arm being coupled to its associated plate to control its vertical movement, and said second arm, manoeuvring said lever, cooperating with actuation means.

12. The apparatus of claim 11, wherein said jolting table is mobile vertically, said placing means for actuating said crosspiece for raising thereof in its raising plane comprises a stop mounted fixed on the upper part of the frame of the stacking apparatus and serving as a stop for the upper edge of said second arm when the mobile table is displaced in its upper extreme position, so as to pivot said lever and provoke a rise of said first arm, each plate and the raising crosspiece.

13. The apparatus of claim 11, wherein each said arm controlling the vertical movement of said crosspiece comprises said auxiliary bearing surface and is mounted to pivot on the end part of the shaft of an upstream guide roller of a conveyor belt.

14. The apparatus of claim 12, wherein each said arm controlling the vertical movement of said crosspiece constituting said auxiliary bearing surface and is mounted to pivot on the end part of the shaft of an upstream guide roller of a conveyor belt.

15. An apparatus for stacking, from above, thin flat articles such as blanks of material, of variable shapes and formats, said blanks being supplied, upstream, on a conveyor and being successively deposited onto one another on the upper laying plane of a stacking-jolting table, comprising:

a frontal stop device having members for stopping leading edges of the blanks;

a lateral jolting device with jolting flaps reciprocatingly mobile in the transverse direction;

said stacking-jolting table having a laying plane comprising a large continuous principal surface, of sufficient extent for supporting stackable blanks of variable shapes and formats, the stacks being formed simultaneously in the transverse direction, and an auxiliary bearing surface located at the upstream end of said table, whereat the rear ends of the stacked blanks are located, extending over the whole width of said principal surface and narrow with respect to the minimum length of the blanks; and means for placing said auxiliary bearing surface at the level of a raising plane at the beginning of the formation of the stack and then for lowering said bearing surface during the rest of formation of said stack and for vertically displacing said auxiliary bearing surface with respect to said principal surface for raising said auxiliary surface with respect to said principal surface for placing it at the level of said raising plane at the beginning of the formation of a new stack, when the first blanks of the stack fall onto a laying plane, being thus maintained inclined with respect to a horizontal plane, and then to lower said auxiliary bearing surface substantially in the plane of the principal surface of the laying plane during the rest of the formation of the stack;

said principal surface of said laying plane being the upper side of an endless conveyor belt extending longitudinally over the chassis of the table.

16. The apparatus of claim 15, wherein said means controlling the vertical displacement of said lifting crosspiece comprises a vertical, longitudinal plate fast with each end of said crosspiece and which is guided to slide vertically, and a pivoting lever having two arms controlling the vertical movement of each plate, a first arm of said two arms being directed upstream and a second arm of said two arms being directed downstream, said first arm being coupled to said associated plate to control its vertical movement, and said second arm, manoeuvring said lever, cooperating with actuation means.

17. The apparatus of claim 16, wherein said jolting table is mobile vertically, said means for actuating said crosspiece for raising thereof in its raising plane are constituted by a stop mounted fixed on the upper part of the frame of the stacking apparatus and serving as a stop for the upper edge of said second arm when the mobile table is displaced in its upper extreme position, so as to pivot said lever and provoke a rise of said first arm, each plate and the raising crosspiece.

18. The apparatus of claim 17, wherein each said arm controlling the vertical movement of said crosspiece constituting said auxiliary bearing surface and is mounted to pivot on the end part of the shaft of an upstream guide roller of a conveyor belt.

19. An apparatus for stacking, from above, thin flat articles such as blanks of material, of variable shapes and formats, said blanks being supplied, upstream, on a conveyor and being successively deposited onto one another on the upper laying plane of a stacking-jolting table, comprising:

a frontal stop device having members for stopping leading edges of the blanks;

a lateral jolting device with jolting flaps reciprocatingly mobile in the transverse direction;

said stacking-jolting table having a laying plane comprising a large continuous principal surface, of sufficient extent for supporting stackable blanks of variable shapes and formats, the stacks being formed simultaneously in the transverse direction, and an auxiliary bearing surface located at the upstream end of said table, whereat the rear ends of the stacked blanks are located, extending over the whole width of said principal surface and narrow with respect to the minimum length of the blanks;

means for placing said auxiliary bearing surface at the level of a raising plane at the beginning of the formation of the stack and then for lowering said bearing surface during the rest of formation of said stack and for vertically displacing said auxiliary bearing surface with respect to said principal surface for raising said auxiliary surface with respect to said principal surface for placing it at the level of said raising plane at the beginning of the formation of a new stack, when the first blanks of the stack fall onto a laying plane, being thus maintained inclined with respect to a horizontal plane, and then to lower said auxiliary bearing surface substantially in the plane of the principal surface of the laying plane during the rest of the formation of the stack; and a frontal stop device comprising stop members in contact with the principal surface of said laying plane.

* * * * *